US006108843A

United States Patent [19]

Suzuki et al.

[11] Patent Number: 6,108,843

[45] Date of Patent: Aug. 29, 2000

[54] AIR BED

[75] Inventors: Kunio Suzuki, Niigata; Masahiko Yasunaga, Mie, both of Japan

[73] Assignee: Aihou Co., Ltd., Niigata, Japan

[21] Appl. No.: 09/079,282

[22] Filed: May 15, 1998

[30] Foreign Application Priority Data

May 15, 1997 [JP] Japan ..... 9-125692

[51] Int. Cl.[7] ..... A47C 27/10

[52] U.S. Cl. ..... 5/713

[58] Field of Search ..... 5/710, 713, 715

[56] References Cited

U.S. PATENT DOCUMENTS

| | | | |
|---|---|---|---|
| 4,797,962 | 1/1989 | Goode | 5/713 |
| 4,864,671 | 9/1989 | Evans | 5/710 |
| 4,944,060 | 7/1990 | Peery et al. | 5/713 |
| 4,982,466 | 1/1991 | Higgins et al. | 5/713 |
| 5,020,176 | 6/1991 | Dotson | 5/713 |
| 5,142,717 | 9/1992 | Everard et al. | 5/713 |
| 5,235,713 | 8/1993 | Guthrie et al. | 5/713 |

FOREIGN PATENT DOCUMENTS

| | | |
|---|---|---|
| 4-307006 | 10/1992 | Japan . |
| 7-42631 | 2/1995 | Japan . |
| 8-332134 | 12/1996 | Japan . |
| 9-38153 | 2/1997 | Japan . |

*Primary Examiner*—Alexander Grosz
*Attorney, Agent, or Firm*—Griffin & Szipl, P.C.

[57] ABSTRACT

There is provided an air bed including (a) a plurality of air chambers arranged adjacent to one another and composed of air-impermeable sheet, (b) an air pump for introducing air to said air chambers, (c) a plurality of on/off valves each of which is located between each of said air chambers and said air pump, (d) a plurality of pressure sensors each of which senses a pressure in each of said air chambers and emits a signal accordingly, and (e) a controller receiving said signal from each of said pressure sensors and controlling on/off of each of said of/off valves in accordance with said signal. In accordance with the above-mentioned air bed, since the air pump is connected to each one of the air chambers, it is possible to control an internal pressure of each of the air chambers. In addition, since air is introduced independently to each of the air chambers from the air pump, it is possible to fill each of the air chambers with air in a shorter period of time than a time required for filling all of air chambers with air in a conventional air bed in which air is introduced to one of air chambers and transferred chamber-to-chamber.

9 Claims, 5 Drawing Sheets

AIR BED

BACKGROUND OF THE INVENTION

1. Field of the Invention

The invention relates to an air bed having a plurality of air chambers arranged in series, each of the air chambers being expanded by introducing air thereinto when in use.

2. Description of the Prior Art

FIG. 1 illustrates one conventional air bed. The illustrated air bed 1 includes five air chambers 1*a*, 1*b*, 1*c*, 1*d* and 1*e* arranged in series and composed of air-impermeable sheet. The five air chambers 1*a* to 1*e* have an elongated shape approximately square in cross section, and are the same in size. Though not illustrated, each of the air chambers 1*a* to 1*e* has a length in a direction perpendicular to a plane of the drawing.

One of the five air chambers 1*a* to 1*e*, for instance, the air chamber 1*b* is connected to an air pump 2. The air pump 2 feeds compressed air into the air chamber 1*b*. An electric power supply 3 is electrically connected to the air pump 2, and supplies electric power to the air pump 2 for its operation. The air pump 2 is connected further to a controller 4 which controls an on/off state of the air pump 2.

The air chamber 1*b* is formed with two pressure governing valves 5. Each of the air chambers 1*a* and 1*c* situated adjacent to the air chamber 1*b* is formed with a three-way valve 6. The air chambers 1*a* and 1*c* are in gas communication with the air chamber 1*b* through the gas governing valves 5 and the three-way valves 6. Similarly, the air chamber 1*c* is in gas communication with the air chamber 1*d* through the gas governing valve 5 and the three-way valve 6, and the air chamber 1*d* is in gas communication with the air chamber 1*e* through the gas governing valve 5 and the three-way valve 6.

Each of the air chambers 1*a* and 1*e* situated at opposite ends of the air bed 1 is formed with an exhaust port 7 through which compressed air existing in the air chambers 1*a* and 1*e* gradually leaks.

The conventional air bed illustrated in FIG. 1 is used as follows.

First, the controller 4 starts the air pump 2 to operate to thereby feed compressed air into the air chamber 1*b*. The pressure governing valves 5 are normally closed, but are open when an ambient pressure exceeds a predetermined pressure. Hence, when an internal pressure of the air chamber 1*b* is over the predetermined pressure, the pressure governing valve 5 is open. As a result, compressed air existing in the air chamber 1*b* is fed into the air chambers 1*a* and 1*c* situated adjacent to the air chamber 1*b*, through the three-way valves 6 of the air chambers 1*a* and 1*c*.

The compressed air is fed into the air chamber 1*d*, and then into the air chamber 1*e* in the same manner.

In the above-mentioned way, each of the air chambers 1*a* to 1*e* has a predetermined internal pressure, and as a result, is expanded to a certain size. Thus, the air bed 1 can be used as a bed.

Even after each of the air chambers 1*a* to 1*e* has acquired a predetermined internal pressure, the air pump 2 is kept operating. Extra compressed air leaks to the atmosphere through the exhaust ports 7 formed at the air chambers 1*a* and 1*e*. By always flowing air through the air chambers, it would be possible to avoid moisture from staying in the air chambers 1*a* to 1*e*.

In general, a head, a body, arms and legs of a man are different in weight. Hence, when a man lies on an air bed, different loads are exerted on the air chambers 1*a* to 1*e*. For instance, since a body of a man is heavier than legs, a load exerted on an air chamber on which a body of a man lies is greater than a load exerted on an air chamber on which legs of a man lie.

Hence, since different loads are exerted on the air chambers, it would be necessary to control a volume of compressed air to be fed into each of the air chambers, in accordance with a load exerted on the air chambers.

However, the compressed air is fed only to the air chamber 1*b* among the five air chambers 1*a* to 1*e*, and then is supplied to the other chambers 1*a*, 1*c*, 1*d* and 1*e* from the air chamber 1*b* in the conventional air bed 1 illustrated in FIG. 1. Accordingly, it would be quite difficult or almost impossible to control a volume of Compressed air to be fed into each of the air chambers to thereby control an internal pressure of each of the air chambers 1*a* to 1*e*.

In addition, the compressed air is fed into the air chambers 1*a*, 1*c*, 1*d* and 1*e* from the air chamber 1*b* one by one in the conventional air bed 1 illustrated in FIG. 1. Hence, it takes much time to fill all the air chambers 1*a* to 1*e* with compressed air. This means that the conventional air bed is not available for emerging uses requiring fast filling and more precise control.

SUMMARY OF THE INVENTION

In view of the above-mentioned problems of the conventional air bed, it is an object of the present invention to provide an air bed which is capable of independently controlling an internal pressure of each of the air chambers and shortening a time necessary for expanding all air chambers.

There is provided an air bed including (a) a plurality of air chambers arranged adjacent to one another and composed of air-impermeable sheet, (b) an air pump for introducing air to the air chambers, (c) a plurality of on/off valves each of which is located between each of the air chambers and the air pump, (d) a plurality of pressure sensors each of which senses a pressure in each of the air chambers and emits a signal accordingly, and (e) a controller receiving the signal from each of the pressure sensors and controlling an on/off of each of the of/off state valves in accordance with the signal.

In accordance with the above-mentioned air bed, each of the air chambers is in communication with the air pump, and hence it is possible to control an internal pressure in each of the air chambers. Each of the air chambers is designed to have a pressure sensor for detecting an internal pressure in each of the air chambers. The detected internal pressure is transmitted to the controller. The controller includes, for instance, a rewritable control map therein in which predetermined pressures for the air chambers are written in advance. The controller compares an internal pressure in the air chamber detected by the pressure sensor to a predetermined pressure written in the control map. If the internal pressure is smaller than the predetermined pressure, the controller opens an on/off valve associated with the air chamber to thereby introduce compressed air into the air chamber from the air pump. Thus, the controller controls an internal pressure in each of the air chambers.

In addition, since compressed air is independently introduced into each of the air chambers, it is possible to fill each of the air chambers with compressed air in a shorter period of time than a time required for filling all of air chambers with compressed air in a conventional air bed in which compressed air is introduced to one of air chambers and transferred chamber-to-chamber. As a result, a time for expanding all of the air chambers can be shortened.

The above-mentioned air bed may be used as a bed for sleeping, a driving seat in a passenger's compartment of an automobile, and a cushion for sitting.

There is further provided an air bed including (a) a plurality of air chambers arranged adjacent to one another and composed of air-impermeable sheet, (b) an air pump for introducing air to the air chambers, (c) a plurality of on/off valves each of which is located between each of the air chambers and the air pump, (d) an air tube connecting the air pump to the on/off valves, (e) a pressure sensor for sensing a pressure in the air tube and emits a signal accordingly, and (f) a controller receiving the signal from the pressure sensor and controlling an on/off state of each of the of/off valves in accordance with the signal.

In accordance with the above-mentioned air bed, each of the air chambers is in communication with the air pump, and hence it is possible to control an internal pressure in each of the air chambers, similarly to the previously mentioned air bed. In addition, it is possible to fill each of the air chambers with compressed air in a shorter period of time than a time required for filling all of air chambers with compressed air in a conventional air bed.

Furthermore, in accordance with the above-mentioned air bed, it would be possible to reduce the number of pressure sensors relative to the previously mentioned air bed.

The air chambers may be arranged in a grid, in which case, an air chamber located closer to an end of the grid may be designed to have a greater length. That is, the air chambers may have different lengths. Thus, a longer air chamber may be set to be higher in height and a shorter air chamber may be set to be lower in height by controlling a volume of compressed air fed from the air pump in such a manner that the longer air chamber has a higher internal pressure and the shorter air chamber has a lower internal pressure. By setting different internal pressures in the air chambers, it is possible to vary a shape of the air bed. For instance, a left half of the air bed can be lower in height, and a right half can be higher in height. As an alternative, a front half of the air bed may be set higher, and a rear half may be set lower. By varying the air bed in shape in such a manner, a man lying on the air bed can alter his position without moving.

When the air chambers are arranged in a grid, air chambers located in a half of the grid may be designed to have a common length, and air chambers located in the other half of the grid may be designed to have such a length that an air chamber located closer to a first end of the grid has a greater length.

The air chambers may be designed to have different widths. For instance, the air chambers may have such a width that an air chamber located closer to a second end of the grip has a greater width, the second end being perpendicular to the first end.

Only the air chambers located in the other half of the grid may be designed to have different widths. For instance, the air chambers located in the other half of the grid may have such a width that an air chamber located closer to a second end of the grip has a greater width, the second end being perpendicular to the first end.

It is preferable that the on/off valves are constituted of at least one rotary valve which selectively introduces air to one of the air chambers. The use of a rotary valve makes it no longer necessary to use an on/off valve for each of the air chambers, ensuring simpler structure and a reduction in fabrication costs in the air bed.

It is preferable that the controller has a rewritable control map in which proper pressures for the air chambers are written. The air bed may have an additional on/off valve arranged in parallel with the on/off valves, air being released to atmosphere through the additional on/off valve.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
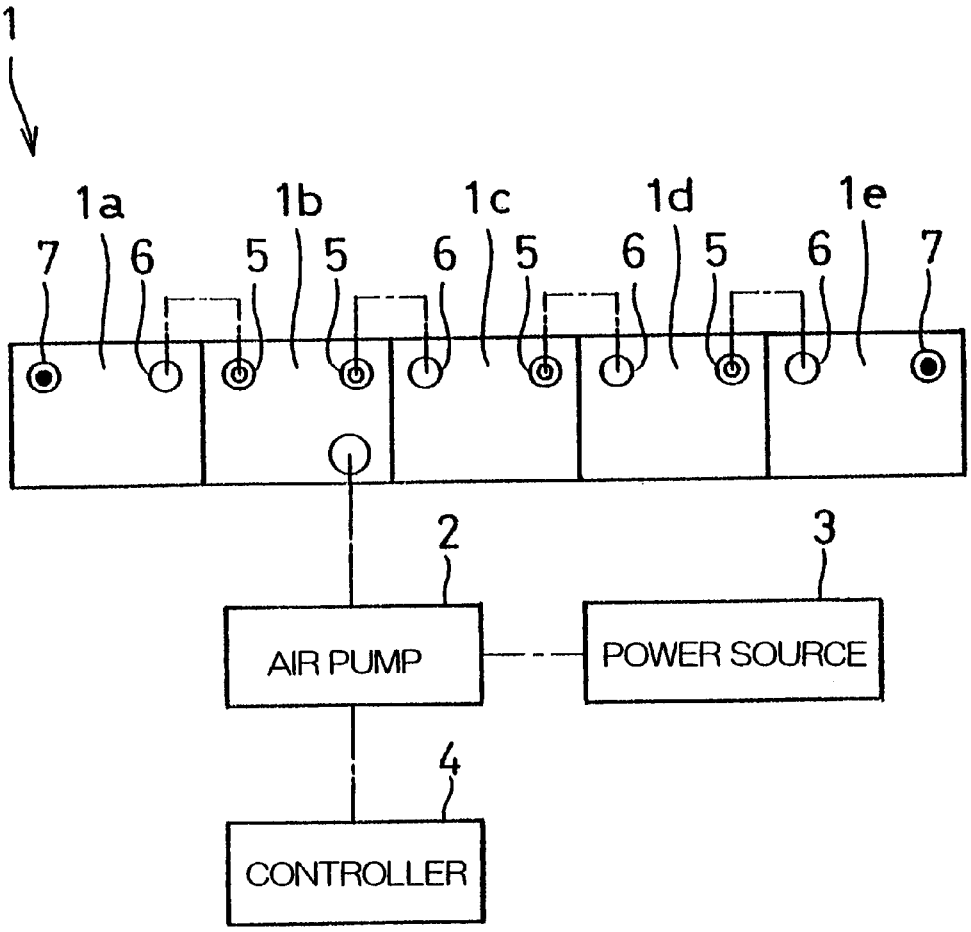
FIG. 1 PRIOR ART
FIG. 1 is a schematic view illustrating a structure of a conventional air bed.
Figure 2:
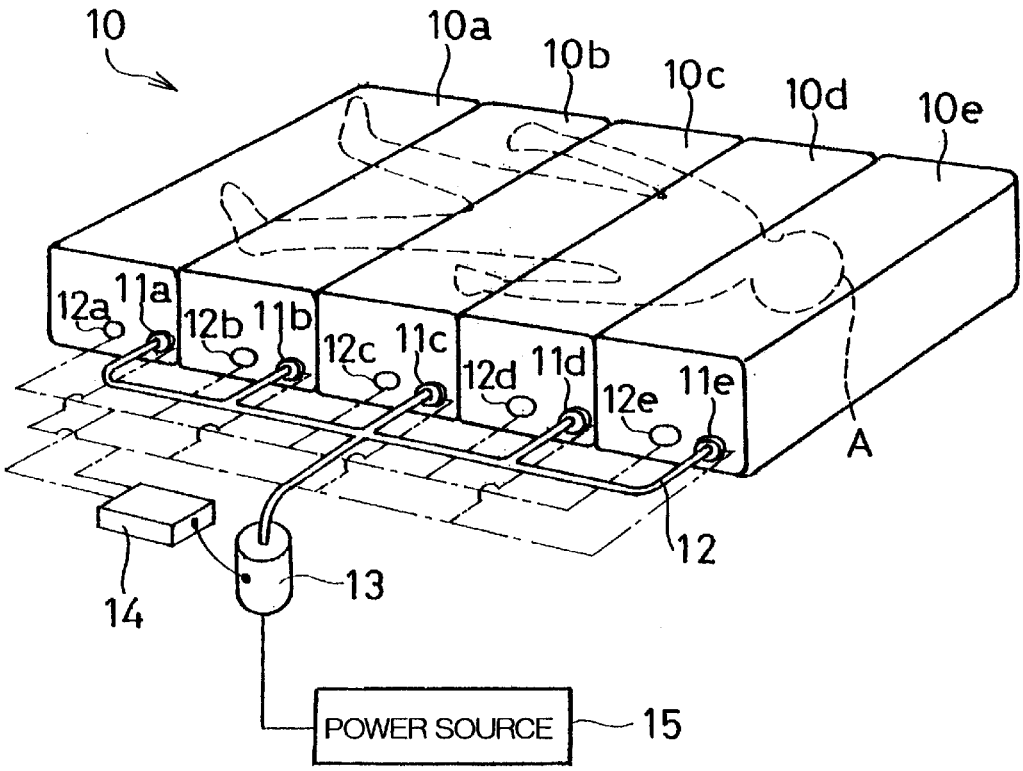
FIG. 2 is a perspective view illustrating an air bed in accordance with the first embodiment of the present invention.

FIG. 2 illustrates an air bed in accordance with the first embodiment. An air bed 10 in accordance with the first embodiment has five air chambers 10*a*, 10*b*, 10*c*, 10*d* and 10*e* each composed of an air-impermeable sheet. Each of the air chambers 10*a* to 10*e* is elongated and square in cross-section when expanded, and is connected to an adjacent chamber at their longer sides.

On/off valves 11*a* to 11*e* are arranged on outer surfaces of the air chambers 10*a* to 10*e*, respectively. Each of the on/off valves 11*a* to 11*e* is designed to be open when it is on, and closed when it is off.

The on/off valves 11*a* to 11*e* are in gas communication with an air pump 13 through an air tube 12. The air pump 13 supplies compressed air to the air chambers 10*a* to 10*e* through the on/off valves 11*a* to 11*e*.

The air pump 13 is electrically connected to a controller 14, which controls the air pump 13 to operate and stop. The on/off valves 11*a* to 11*e* are electrically connected to the controller 14, and turned on or off in accordance with a control signal transmitted from the controller 14.

Pressure sensors 12*a* to 12*e* are secured to the air chambers 10*a* to 10*e* for detecting internal pressures in the air chambers 10*a* to 10*e* to thereby transmit a pressure-detecting signal accordingly to the controller 14.

The air pump 13 is also electrically connected to an electric power supply 15 from which an electric power is supplied to the air pump 13.

The air bed 10 having the above-mentioned structure is used as follows.

First, the controller 14 transmits a control signal to all the on/off valves 11*a* to 11*e* to thereby turn the on/off valves 11*a* to 11*e* on. Then, the controller 14 starts the air pump 13 to operate to thereby feed a predetermined volume of compressed air to each of the air chambers 10*a* to 10*e* for expanding the air chambers 10*a* to 10*e* to some degree.

Since compressed air is concurrently fed to the air chambers 10*a* to 10*e* unlike a conventional air bed, all the air chambers 10*a* to 10*e* can be expanded in a shorter period of time than a time required for expanding all air chambers in a conventional air bed.

Then, a man A illustrated in FIG. 2 with a broken line lies on the air bed 10. As a result, since a load caused by the man A is exerted on each of the air chambers 10*a* to 10*e*, compressed air existing in each of the air chambers 10*a* to 10*e* gradually leaks, and an internal pressure in each of the air chambers 10*a* to 10*e* decreases accordingly. For instance, since a body is heavier than legs of the man A, internal pressures in the air chambers 10*c* and 10*d* on which the body of the man A lies are reduced to a greater degree than a degree of reduction in internal pressures of the air chambers 10*a* and 10*b* on which the legs of the man A lie. Thus, an internal pressure in the air chambers 10*a* to 10*e* is reduced in dependence on a part of the man A lying thereon.

When an internal pressure in the each of the air chambers 10*a* to 10*e* is reduced, the pressure sensors 12*a* to 12*e* associated with the air chambers 10*a* to 10*e*, respectively, detect a reduction in an internal pressure, and transmit a pressure-detecting signal indicative of the reduction, to the controller 14.

The controller 14 includes a rewritable control map therein in which appropriate internal pressures of the air chambers 10*a* to 10*e* are written. The controller 14 receiving the pressure-detecting signal compares an internal pressure indicated by the pressure-detecting signal to an appropriate pressure stored in the control map for each of the air chambers 10*a* to 10*e*. Then, the controller 14 judges whether compressed air is to be introduced into each of the air chambers 10*a* to 10*e* from the air pump 13.

Then, the controller 14 transmits control signals to the on/off valves 11*a* to 11*e* to thereby turn them on. As a result, the air chambers 10*a* to 10*e* are in gas communication with the air pump 13, and then compressed air is introduced into the air chambers 10*a* to 10*e* from the air pump 13. A volume of compressed air to be introduced into the air chambers 10*a* to 10*e* is dependent on a period of time during which the air chambers 10*a* to 10*e* are in gas communication with the air pump 13. Such a period of time is determined in accordance with a reduction in an internal pressure in each of the air chambers 10*a* to 10*e*.

As mentioned so far, even if internal pressures in the air chambers 10*a* to 10*e* are reduced, the controller 14 controls the air pump 13 to supply compressed air to the air chambers 10*a* to 10*e* in dependence on reduction in an internal pressure in the air chambers 10*a* to 10*e*, resulting in that the air chambers 10*a* to 10*e* are kept at a predetermined pressure stored in the control map installed in the controller 14.

If a predetermined pressure for each of the air chambers 10*a* to 10*e* is to be altered, the control map installed in the controller 14 is rewritten.

In accordance with the above-mentioned first embodiment, even if an internal pressure or internal pressures in one or more of the air chambers 10*a* to 10*e* is (are) reduced, the controller 14 controls the air pump 13 to supply compressed air to the air chamber(s) in dependence on a reduction in an internal pressure in the air chamber(s). Accordingly, the air chambers 10*a* to 10*e* can be kept at a predetermined internal pressure.

Variant of First Embodiment

Figure 3:
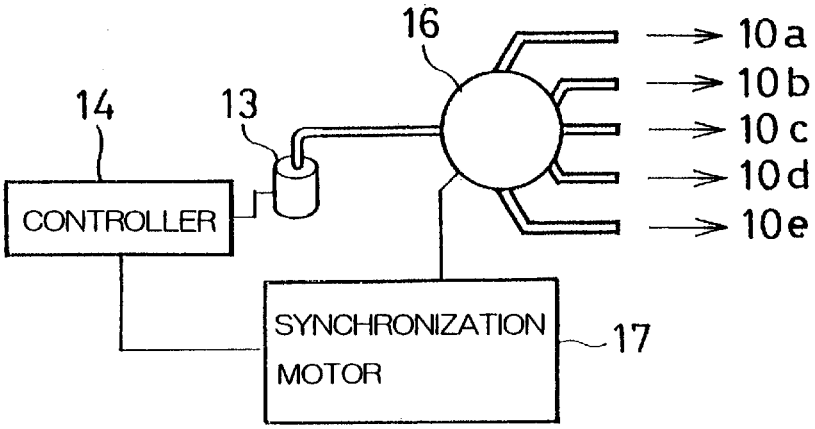
FIG. 3 is a schematic view partially illustrating an air bed in accordance with a variant of the first embodiment.

FIG. 3 illustrates a variant of the above-mentioned first embodiment. In this variant, the on/off valves 11*a* to 11*e* are replaced with a rotary valve 16. Compressed air is fed into the air chambers 10*a* to 10*e* from the air pump 13 through the rotary valve 16. The rotary valve 16 is driven by a synchronization motor 17, which is controlled by the controller 14. The controller 14 controls the synchronization motor 17 to thereby drive the rotary valve 16 in accordance with the pressure-detecting signals transmitted from the pressure sensors 12*a* to 12*e* so that the air pump 13 is in gas communication only with one of the air chambers 10*a* to 10*e*.

Second Embodiment

Figure 4:
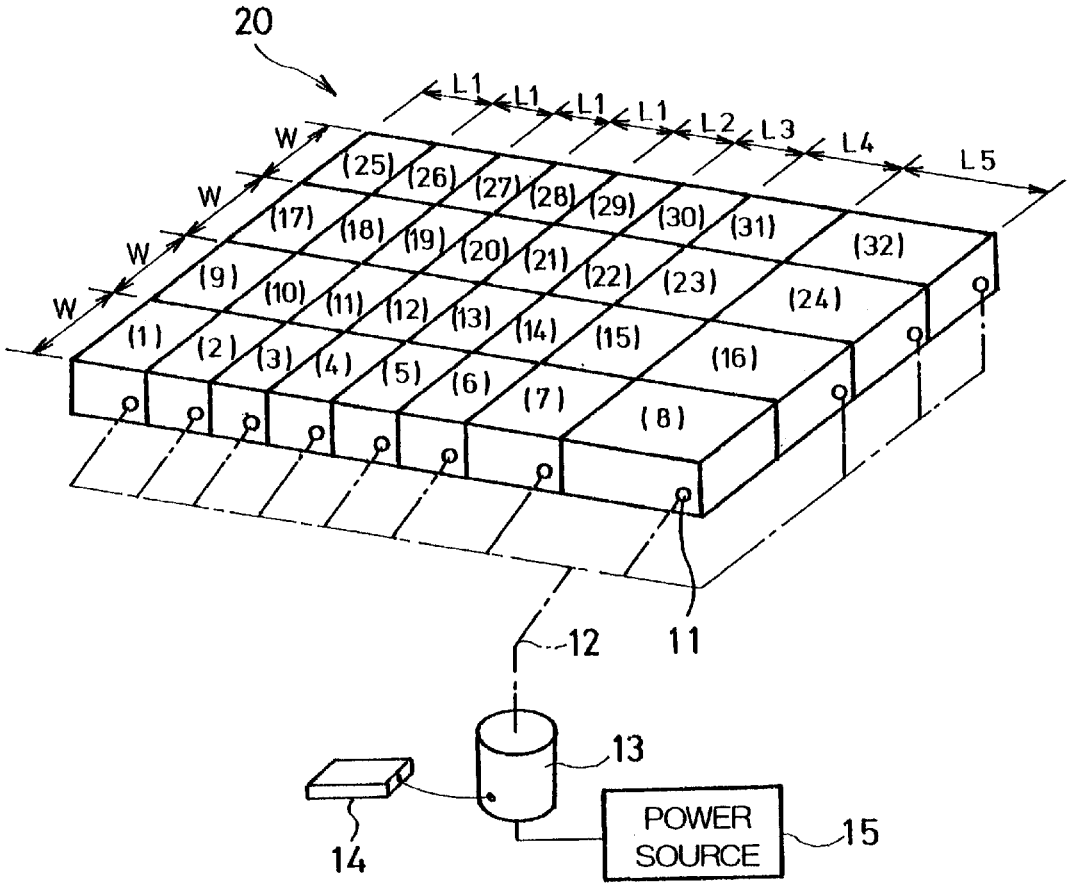
FIG. 4 is a perspective view illustrating an air bed in accordance with the second embodiment of the present invention.

FIG. 4 illustrates an air bed in accordance with the second embodiment. The illustrated air bed 20 is designed to have thirty two air chambers 1 to 32 arranged in a grid. Hereinafter, the air chambers are numbered with the figures in parentheses, as illustrated in FIG. 4. For instance, an air chamber located at a frontmost and rightmost row is called an air chamber 8.

Each of the air chambers 1 to 32 is designed to have an on/off valve 11, which is in gas communication with an air pump 13 through an air tube 12, and a pressure sensor (not illustrated) for detecting an internal pressure therein. The pressure sensors are electrically connected to a controller 14.

All the air chambers 1 to 32 cooperate with one another to thereby form a rectangle. The sixteen air chambers 1–4, 9–12, 17–20 and 25–28 situated in a left half of the rectangle are designed to have a common length L1, whereas the sixteen air chambers 5–8,13–16, 21–24 and 29–32 situated in a right half of the rectangle are designed to have an increasing length. Specifically, the air chambers 5, 13, 21 and 29 are designed to have a length L2, the air chambers 6, 14, 22 and 30 are designed to have a length L3, the air chambers 7, 15, 23 and 31 are designed to have a length L4, and the air chambers 8, 16, 24 and 32 are designed to have a length L5. A relation among the lengths L1, L2, L3, L4 and L5 is as follows.

$L1<L2<L3<L4<L5$

The thirty two air chambers 1 to 32 are designed to have a common width. Herein, a length is defined as a length measured in a direction of a longer side of the rectangle, and a width is defined as a length measured in a direction of a shorter side of the rectangle.

By designing the thirty two air chambers 1 to 32 to have such a length as mentioned above, the air bed 20 in accordance with the instant embodiment can be used in various ways as follows.

For instance the sixteen air chambers 1–4, 9–12, 17–20 and 25–28 situated in a left half of the rectangle are kept at an internal pressure P1, and the remaining sixteen air chambers are designed to have an increasing internal pressure. Specifically, the air chambers 5, 13, 21 and 29 are kept at an internal pressure P2, the air chambers 6, 14, 22 and 30 are kept at an internal pressure P3, the air chambers 7, 15, 23 and 31 are kept at an internal pressure P4, and the air chambers 8, 16, 24 and 32 are kept at an internal pressure P5. A relation among the internal pressures P1, P2, P3, P4 and P5 is as follows.

$P1<P2<P3<P4<P5$

It is possible to design the air chambers 1 to 32 to have the above-mentioned internal pressures, for instance, by inputting the above-mentioned internal pressures in the control map installed in the controller 14 as a predetermined internal pressure for each of the air chambers 1 to 32.

Figure 5:
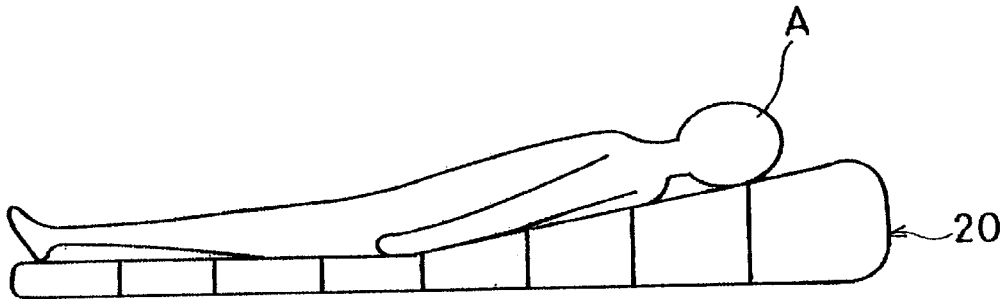
FIG. 5 is a front view of the air bed illustrated in FIG. 4 when used in a manner.
Figure 6:
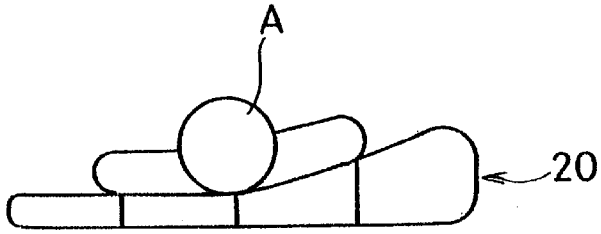
FIG. 6 is a front view of the air bed illustrated in FIG. 4 when used in another manner.

The internal pressures in the air chambers 1 to 32 are set as mentioned above, and compressed air is fed into the air chambers 32 from the air pump 13 in accordance with the thus set internal pressures. As a result, as illustrated in FIG. 5, the air bed 20 has a constant height in a left half thereof, and an increasing height in a right half thereof. Thus, the man A lying on the air bed 20 can get up without moving himself.

As an alternative to the above-mentioned example, air chambers situated in a front half, that is, the air chambers 1 to 16 are kept at an internal pressure P1, and air chambers situated in a rear half, that is, the air chambers 17 to 32 are kept at an internal pressure P2 (P2>P1).

By setting the internal pressures in the air chambers in such a manner as mentioned above, the air chambers situated in a rear half, that is, the air chambers 17 to 32 become higher in height than the air chambers situated in a front half, that is, the air chambers 1–16. Hence, the man A lying on the air bed 20 can readily turn over without moving himself.

As mentioned so far, in accordance with the air bed 20, it would be possible to shift a sleeping position of a man lying thereon merely by appropriately varying internal pressures in the air chambers 1–32. Hence, the air bed 20 in accordance with the second embodiment is suitable in particular to a serious case.

The air bed 20 is not to be limited to the structure illustrated in FIG. 4, but may have a different structure. For instance, the air chambers may be designed to have different widths W. For instance, the air chambers 1–32 may be designed to have such a width that an air chamber located closer to an end of the rectangle has a greater width. Specifically, the air chambers 1 to 8 are designed to have a width W1, the air chambers 9 to 19 are designed to have a width W2, the air chambers 17 to 24 are designed to have a width W3, and the air chambers 25 to 32 are designed to have a width W4 wherein the widths W1, W2, W3 and W4 are defined as W1<W2<W3<W4.

As an alternative, air chambers situated in a half may be designed to have a common width, and air chambers situated in the other half may be designed to have an increasing width.

The air bed 20 may be designed to have the air chambers 1 to 32 which are varied in their length, width, or both.

Third Embodiment

Figure 7:
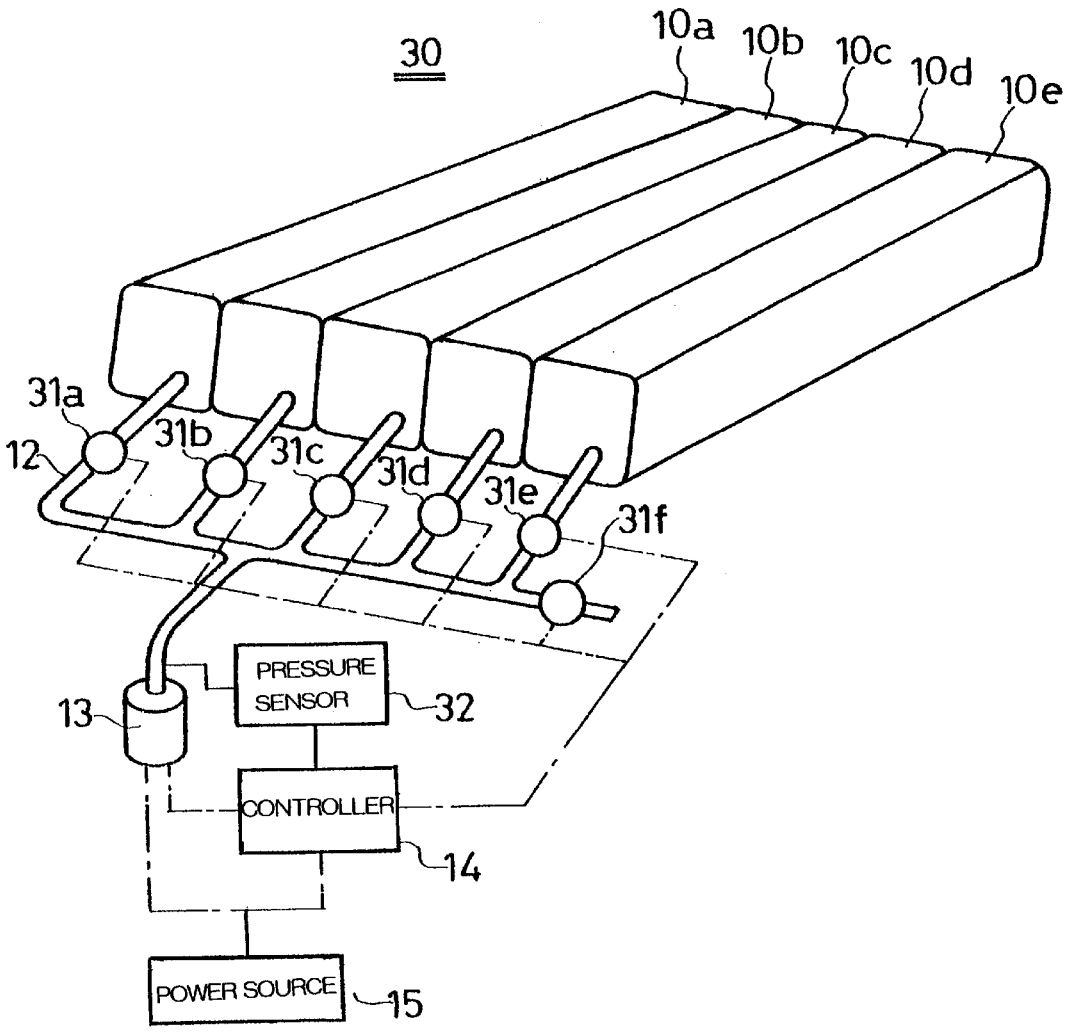
FIG. 7 is a perspective view illustrating an air bed in accordance with the third embodiment of the present invention.

FIG. 7 illustrates an air bed in accordance with the third embodiment of the present invention. The illustrated air bed 30 has five air chambers 10*a* to 10*e* arranged in series and composed of air-impermeable sheet.

Each of the air chambers 10*a* to 10*e* is connected to a solenoid valve 31*a* to 31*e*, respectively, and further to an air pump 13 through an air tube 12. The solenoid valves 31*a* to 31*e* are controlled by a controller 14 to turn on or off. When the solenoid valves 31*a* to 31*e* are off, the solenoid valves 31*a* to 31*e* interrupt communication between the air pump 13 and the air chambers 10*a* to 10*e*, and when on, the solenoid valves 31*a* to 31*e* communicate the air pump 13 to the air chambers 10*a* to 10*e*.

An additional solenoid valve 31*f* is positioned in the air tube 12 in parallel with the solenoid valves 31*a* to 31*e*. The additional solenoid valve 31*f* communicates the air tube 12 to atmosphere, when turned on, for releasing extra compressed air to atmosphere.

The air pump 13 is electrically connected to a controller 14, which controls the air pump 13 to start and stop its operation. The on/off valves 31*a* to 31*e* and 31*f* are electrically connected to the controller 14, and turned on or off in accordance with a control signal transmitted from the controller 14.

A pressure sensor 32 is in gas communication with the air tube 12 which connects the air pump 13 to the solenoid valves 31*a* to 31*e*. The pressure sensor 32 detects an internal pressure in the air tube 12 to thereby transmit a pressure-detecting signal accordingly to the controller 14.

The air pump 13 and the controller 14 are also electrically connected to an electric power supply 15 from which an electric power is supplied to the air pump 13 and the controller 14.

The air bed 30 having the above-mentioned structure is used as follows.

The controller 14 turns only the solenoid valve 31*a* on, and keeps the other solenoid valves 31*b* to 31*f* off. Thereafter, the controller 14 operates the air pump 13, and thus compressed air is fed only into the air chamber 10*a* from the air pump 13.

While compressed air is being fed into the air chamber 10*a* from the air pump 13, the pressure sensor 32 keeps detecting an internal pressure in the air tube 12 and transmitting a pressure-detecting signal indicative of the detected internal pressure, to the controller 14.

An internal pressure in the air tube 12 is equal to an internal pressure in the air chamber 10*a*. Hence, the controller 14 stops the air pump 13 to operate when an internal pressure in the air tube 12 reaches a predetermined pressure, in accordance with the pressure-detecting signal transmitted from the pressure sensor 32. At the same time, the controller 14 turns the solenoid valve 31*a* off. Thus, the air chamber 10*a* is kept at a predetermined internal pressure.

Thereafter, compressed air is introduced in turn into each of the air chambers 10*b* to 10*e* from the air pump 13, and each of the air chambers 10*a* to 10*e* is kept at a predetermined internal pressure in the same manner as the air chamber 10*a*.

The compressed air may be still existent in the air tube 12, even after all the air chambers 10*a* to 10*e* have been expanded. Hence, the controller 14 turned the additional solenoid valve 31*f* on, after the compressed air was introduced into the air chamber 10*e*, to thereby release the compressed air still existent in the air tube 12, to atmosphere.

The controller 14 is equipped with a rewritable control map in which desired pressures for the air chambers 10*a* to 10*e* can be stored. Hence, it is possible to have the air chambers 10*a* to 10*e* had different internal pressures by writing different internal pressures for the air chambers 10*a* to 10*e* into the control map.

As mentioned so far, in accordance with the third embodiment, compressed air is fed independently into each of the air chambers 10*a* to 10*e* by means of the controller 14, and hence it is possible to set a desired internal pressure in each of the air chambers 10*a* to 10*e*.

In addition, it is also possible to reduce the number of pressure sensors relative to the above-mentioned first and second embodiments.

Similarly to the second embodiment, the air chambers may be arranged in a grid in the instant embodiment. In place of the solenoid valves 31*a* to 31*f*, there may be employed a rotary valve as illustrated in FIG. 3.

In the above-mentioned first to third embodiments, the air bed in accordance with the present invention is exemplified as a bed for sleeping thereon. As an alternative, the air bed in accordance with the present invention may be applied to various uses such as a driving seat in an automobile and a cushion or sofa for sitting thereon.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-125692 filed on May 15, 1997 including specification, claims, drawings and summary is incorporated herein by reference in its entirety.

What is claimed is:

1. An air bed comprising:

(a) a plurality of air chambers arranged adjacent to one another and composed of air-impermeable sheet;

(b) an air pump for introducing air to said air chambers;

(c) plurality of on/off valves each of which is located between each of said air chambers and said air pump;

(d) an air tube connecting said air pump to said on/off valves;

(e) a single pressure sensor disposed to sense pressure in said air tube and emit a pressure signal; and (f) a controller receiving said signal from said pressure sensor and controlling an on/off state of each of said on/off valves in accordance with said signal, said controller having a rewritable control map in which proper pressures for said air chambers are written.

2. The air bed as set forth in claim 1, wherein said air chambers are arranged in a grid, an air chamber located closer to an end of said grid being designed to have a greater length.

3. The air bed as set forth in claim 2, wherein said air chambers have different widths.

4. The air bed as set forth in claim 3, wherein said air chambers have such a width that an air chamber located closer to a second end of said grip has a greater width, said second end being perpendicular to said first end.

5. The air bed as set forth in claim 1, wherein said air chambers are arranged in a grid, air chambers located in a half of said grid being designed to have a common length, and air chambers located in the other half of said grid being designed to have such a length that an air chamber located closer to a first end of said grid has a greater length.

6. The air bed as set forth in claim 5, wherein said air chambers located in the other half of said grid have different widths.

7. The air bed as set forth in claim 6, wherein said air chambers located in the other half of said grid have such a width that an air chamber located closer to a second end of said grip has a greater width, said second end being perpendicular to said first end.

8. The air bed as set forth in claim 1, wherein said on/off valves are constituted of at least one rotary valve which selectively introduces air to one of said air chambers.

9. The air bed as set forth in claim 1, further comprising an additional on/off valve arranged in parallel with said on/off valves, air being released to atmosphere through said additional on/off valve.

* * * * *